US011131534B2

(12) United States Patent
Lee et al.

(10) Patent No.: US 11,131,534 B2
(45) Date of Patent: Sep. 28, 2021

(54) CONNECTOR FOR BLAST-TRIGGERING DEVICE

(71) Applicant: HANWHA CORPORATION, Seoul (KR)

(72) Inventors: Eung So Lee, Boeun-gun (KR); Ki Chul Park, Boeun-gun (KR); Se Hun Kim, Boeun-gun (KR); Kyu Jin Ha, Boeun-gun (KR)

(73) Assignee: HANWHA CORPORATION, Seoul (KR)

( * ) Notice: Subject to any disclaimer, the term of this patent is extended or adjusted under 35 U.S.C. 154(b) by 25 days.

(21) Appl. No.: 16/627,106

(22) PCT Filed: Jun. 28, 2017

(86) PCT No.: PCT/KR2017/006846

§ 371 (c)(1),
(2) Date: Dec. 27, 2019

(87) PCT Pub. No.: WO2019/004495

PCT Pub. Date: Jan. 3, 2019

(65) Prior Publication Data

US 2021/0148688 A1 May 20, 2021

(51) Int. Cl.
*F42D 1/00* (2006.01)
*F42D 1/04* (2006.01)

(52) U.S. Cl.
CPC ..... *F42D 1/043* (2013.01)

(58) Field of Classification Search
CPC ..... F42D 1/043
See application file for complete search history.

(56) References Cited

U.S. PATENT DOCUMENTS 5,703,319 A * 12/1997 Fritz ..... F42D 1/043 102/275.7
5,792,975 A * 8/1998 Tseka ..... C06C 5/06 102/275.7

(Continued)

FOREIGN PATENT DOCUMENTS

JP 11-513786 A 11/1999
JP 2003-532050 A 10/2003
KR 20-2010-0010019 U 10/2010

OTHER PUBLICATIONS

International Search Report dated Dec. 28, 2017, issued in counterpart International Application No. PCT/KR2007/006846, with English Translation. (6 pages).

*Primary Examiner* — J. Woodrow Eldred
(74) *Attorney, Agent, or Firm* — Westerman, Hattori, Daniels & Adrian, LLP

(57) ABSTRACT

The present disclosure relates to a connector for a blast-triggering device, said connector including a connector head in which a rear end thereof is integrally connected with a rear surface of a connector body, an upper surface thereof is formed in a curved surface extending from the rear end thereof to a front end thereof, a tube insertion portion is provided between a lower surface thereof and the connector body so that a plurality of shock tubes is fitted therein, and the front end thereof is separated from the connector body. Thus, it is possible to maintain the shape of the connector during detonation, thereby minimizing the generation of debris and improving the safety at the time of detonation. In addition, it is possible to prevent damage to the plurality of shock tubes, thereby preventing a cut-off phenomenon caused by damaged shock tubes during detonation.

14 Claims, 6 Drawing Sheets

(56) References Cited

U.S. PATENT DOCUMENTS

| | | | | |
|---|---|---|---|---|
| 6,513,437 | B2 | 2/2003 | Chan et al. | |
| 2002/0162473 | A1* | 11/2002 | Chan | F42D 1/043 102/275.7 |
| 2003/0084812 | A1* | 5/2003 | Perry | C06C 5/06 102/275.7 |
| 2004/0055494 | A1* | 3/2004 | O'Brien | C06C 5/06 102/275.12 |

* cited by examiner

CONNECTOR FOR BLAST-TRIGGERING DEVICE

TECHNICAL FIELD

The present invention relates to a connector for a blast-triggering device and, more particularly, to a connector for a blast-triggering device configured to minimize scattering of debris during detonation of a detonation, and secure detonation reliability.

BACKGROUND ART

Generally, a nonelectric blasting device uses a blast-triggering device in order to simultaneously transmit an explosion signal to a plurality of detonators for igniting an explosive.

That is, the blast-triggering device is configured to simultaneously apply the explosion signal to a plurality of shock tubes connected to the plurality of detonators for igniting an explosive in order to simultaneously detonate the plurality of detonators for igniting the explosive.

The nonelectric blast-triggering device includes: a connector, in which a plurality of shock tubes is fitted; and a trunkline delay detonator, which applies an explosion signal to the shock tubes inserted into the connector.

The plurality of shock tubes is configured such that an explosive is inserted therein, and a plurality of detonators for igniting an explosive is connected thereto, so that the explosion signal is transmitted to the plurality of detonators for igniting the explosive through the explosive.

That is, the nonelectric blast-triggering device is operated as follows. The shock tubes connected to the detonators for igniting the explosive are fitted into the connector, and then, as the trunkline delay detonator inserted into the connector detonates, the explosion signal is simultaneously transmitted to the shock tubes through the explosive, and the detonators for igniting the explosive connected to the shock tubes detonate simultaneously therewith.

FIG. 1 is a schematic view showing a connector for a conventional blast-triggering device. Referring to FIG. 1, the connector 5 for the conventional blast-triggering device has a straight rod shape, and has a tube insertion portion 5*a* in which a plurality of shock tubes 1 is fitted at an upper portion of the connector 5, and has a detonator-coupling portion 5*b* in which a trunkline delay detonator 2 is inserted in the longitudinal direction of the detonator-coupling portion 5*b*, the detonator-coupling portion 5*b* being formed to penetrate up to the tube insertion portion 5*a*.

The connector 5 of a conventional blast-triggering device has a flat upper surface. Also, an upper end of the trunkline delay detonator 2 is formed in a flat surface parallel to the upper surface of the connector 5 for the blast-triggering device.

The upper end of the trunkline delay detonator 2 protrudes partway into the tube insertion portion 5*a*. The shock tubes 1 are fitted between an inner circumferential surface of the tube insertion portion 5*a* and an outer circumferential surface of the trunkline delay detonator 2.

However, the connector 5 for a conventional blast-triggering device has a problem in that the connector 5 does not maintain the shape thereof during detonation of the trunkline delay detonator 2, and explodes, generating large amounts of debris.

Further, the connector 5 for a conventional blast-triggering device has a problem in that the connector does not maintain the shape thereof after detonation and is damaged, causing damage to the shock tubes 1 to generate a cut-off phenomenon (disconnection, blast failure) of the shock tubes 1.

Further, because the upper end of the trunkline delay detonator 2 is formed to have a flat upper surface and the inner circumferential surface of the tube insertion portion 5*a* is a flat surface corresponding to the flat upper surface of the trunkline delay detonator 2, a gap is formed between the trunkline delay detonator 2 and the shock tubes 1, and thus shock waves are not uniformly applied to the shock tubes during detonation of the detonator.

DISCLOSURE

Technical Problem

Accordingly, the present invention has been made keeping in mind the above problems occurring in the prior art, and an object of the present invention is to provide a connector for a blast-triggering device, the connector being capable of maintaining a shape thereof during detonation, and of improving closeness of contact with a shock tube connected to a connection detonator (trunkline delay detonator) and a detonator for initiating an explosive in the connector.

Technical Solution

In order to accomplish the above object, the present invention provides a connector for a blast-triggering device, the connector includes: a connector body having a rectangular rod shape including front and rear surfaces and opposite side surfaces, and having therein a detonator insertion portion, which passes through the connector body in a longitudinal direction of the connector body, so that a detonator is inserted into the detonator insertion portion; a connector head configured such that a rear end thereof is integrally connected with a rear surface of the connector body, an upper surface thereof is formed in a curved surface extending from the rear end thereof to a front end thereof, a tube insertion portion of a void is provided between a lower surface thereof and the connector body so that the plurality of shock tubes connected to the detonator for initiating an explosive is fitted therein, and the front end thereof is separated from the connector body; a clip-fixing body, which is integrally provided with a lower end of the connector body, is formed by protruding from a circumference of the lower end of the connector body, has an opening of the detonator insertion portion in a lower surface thereof, and has a clip-fitting portion formed by passing through opposite side surfaces of the clip-fixing body; and a fixing clip fitted in the clip-fitting portion to fix a trunkline delay detonator that is inserted into the detonator insertion portion.

The connector body, the connector head, and the clip-fixing body may be integrally formed in a single body, and be each made by using one material or mixing at least two materials selected from among high-density polyethylene, intermediate-density polyethylene, polypropylene, metallocene linear low-density polyethylene, and polyamide.

An upper end of the trunkline delay detonator may be formed in a hemispherical shape around a central upper flat surface thereof and protrudes into the tube insertion portion, and a lower surface of the connector head may have a flat surface corresponding to the central upper flat surface of the trunkline delay detonator and a curved surface corresponding to the hemispherical shape thereof.

The curved surface among the lower surface of the connector head may have the same center as the hemispherical shape of the trunkline delay detonator.

The connector body may have a main body member having a rectangular rod shape; and a head-supporting member provided at an upper end of the main body member, formed by extending outwards from a circumference of the main body member, and formed such that a rear surface thereof is integrally connected with the connector head and a front surface thereof is separated from a front end of the connector head.

The head-supporting member may have a guide protrusion at the front surface thereof, and the guide protrusion may be configured to be in contact with the front end of the connector head and is formed such that a gap between the guide protrusion and the connector head gradually widens from a contact portion with the connector head toward the front end of the connector head.

The main body member may be provided with a first horizontal groove and a second horizontal groove spaced apart from each other in a front surface thereof, the first horizontal groove and the second horizontal groove being open toward opposite sides of the main body member, respectively, a plurality of first horizontal grooves being spaced apart from each other in a longitudinal direction of the main body member, and a plurality of second horizontal grooves being spaced apart from each other in the longitudinal direction of the main body member, and the main body member may be provided with a third horizontal groove and a fourth horizontal groove spaced apart from each other in a rear surface thereof, the third horizontal groove and the fourth horizontal groove being open toward the opposite sides of the main body member, respectively, a plurality of third horizontal grooves being spaced apart from each other in the longitudinal direction of the main body member, and a plurality of fourth horizontal grooves being spaced apart from each other in the longitudinal direction of the main body member.

An upper surface of the connector body may be provided with side protrusions for supporting tubes, the side protrusions for supporting tubes protruding into the tube insertion portion to be spaced apart from each other, and receiving an upper end of the trunkline delay detonator therebetween.

The side protrusions for supporting tubes each may have a semicircular shape when viewed from a lateral direction of the connector body.

The side protrusions for supporting tubes each may have the same radius as the hemispherical shape in the upper end of the trunkline delay detonator.

The fixing clip may be provided with a tube-fitting groove in which a detonation tube connected to the trunkline delay detonator may be fitted, so that a lower end of the trunkline delay detonator may be supported when the detonation tube is inserted into and fitted in the tube-fitting groove.

A total length including the connector body, the connector head, and the clip-fixing body may be 65~110 mm.

A thickness between opposite side surfaces of the connector body may be 15~50 mm.

A diameter of the detonator insertion portion may be 7.1~9.5 mm.

A thickness between the upper surface and the lower surface of the connector head may be 3~15 mm.

A gap between the lower surface of the connector head and an outer upper circumferential surface of the side protrusion for supporting tubes may be 2.5~4.5 mm.

Advantageous Effects

As described above, to maintain the shape of a connector during detonation in order to minimize the generation of debris, so that safety during detonation can be improved.

The present disclosure is configured to maintain the shape of the connector so as to prevent damage, due to the debris, from occurring to a plurality of shock tubes connected to the detonator for initiating an explosive, so that the cut-off phenomenon due to the damage of the shock tubes during detonation can be prevented and detonation reliability can be improved.

The present disclosure is configured to improve closeness of contact with a plurality of shock tubes connected to a trunkline delay detonator and a detonator for initiating an explosive that are inserted in the connector so as to uniformly apply shock waves to each of the shock tubes during detonation. Accordingly, uniformity of an input signal applied to a shock tube can be secured, an explosion signal can be uniformly applied to a plurality of detonators for initiating an explosion, and malfunction of a detonator for initiating an explosion can be prevented.

DESCRIPTION OF REFERENCE NUMERALS

Figure 1:
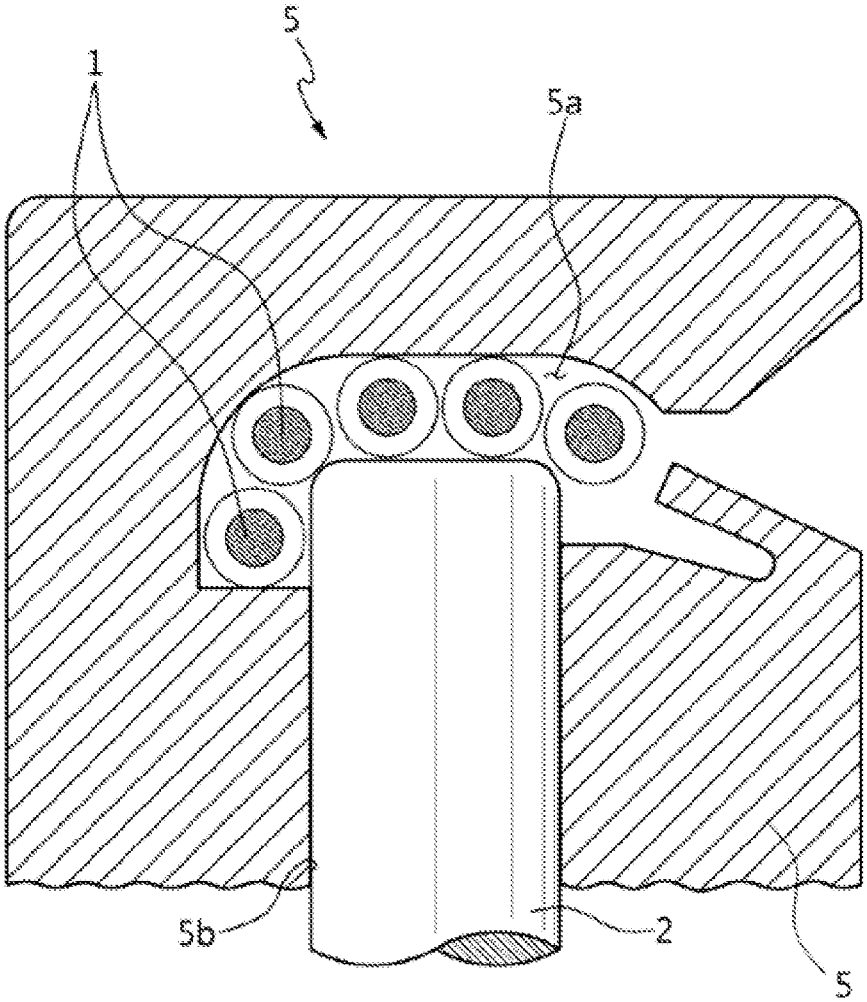
FIG. 1 (Prior Art)
FIG. 1 is a schematic view showing a connector for a conventional blast-triggering device.

1: shock tube 2: trunkline delay detonator
100: connector body
101: detonator insertion portion
110: main body member
111: first horizontal groove
112: second horizontal groove
113: third horizontal groove
114: fourth horizontal groove
120: head-supporting member
121: guide protrusion
130: side protrusion for supporting tubes
200: connector head
200*a*: tube insertion portion
210: head protrusion 300: clip-fixing body
310: clip-fitting portion 400: fixing clip
410: tube-fitting groove

BEST MODE

Hereinafter, the present disclosure will be described in detail with reference to the accompanying drawings. In the following description, when the detailed description with respect to the functions of conventional elements and the configuration thereof may make the gist of the present disclosure unclear, the detailed description thereof will be omitted. The embodiment of the present disclosure is provided to enable those skilled in the art to more clearly comprehend the present disclosure. Therefore, it should be understood that the shape and size of the elements shown in the drawings may be exaggeratedly illustrated in order to provide an easily understood description of the structure of the present disclosure.

Figure 2:
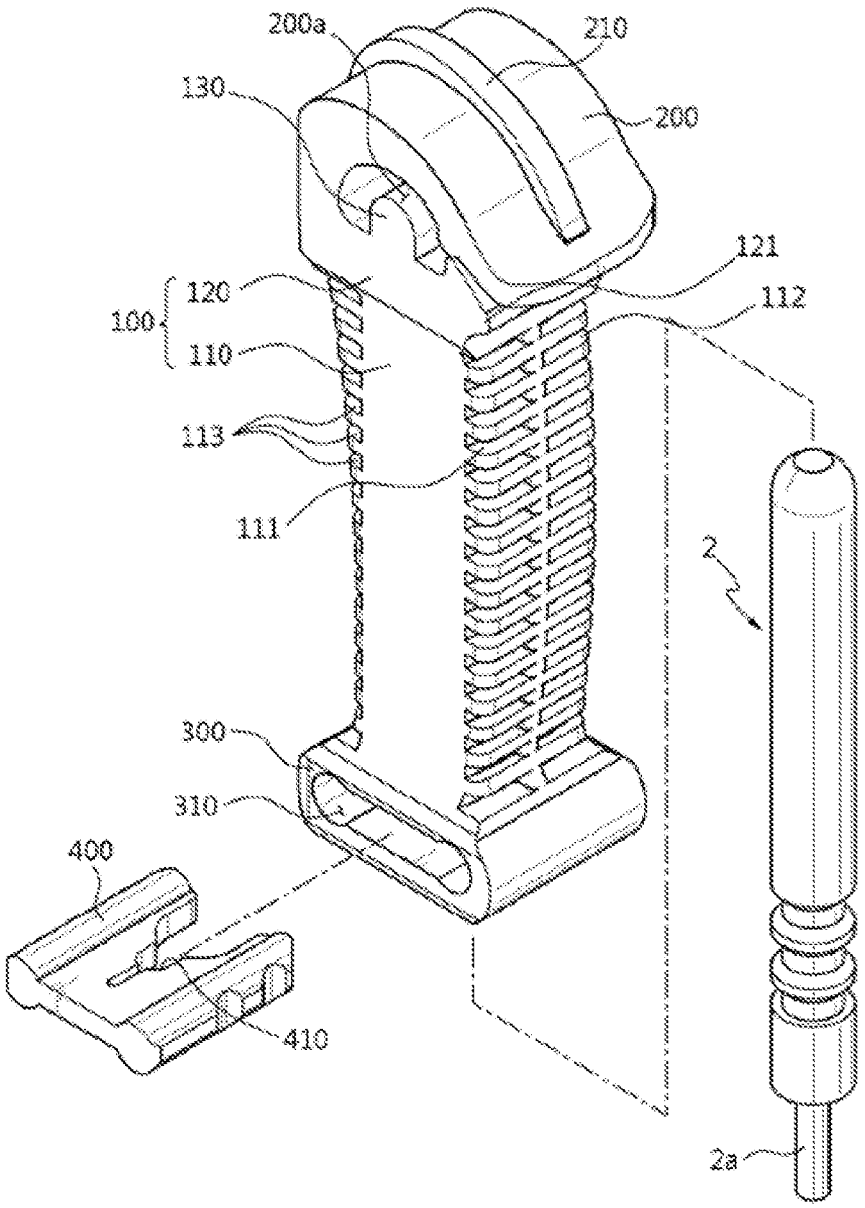
FIG. 2 is a perspective view showing a connector for a blast-triggering device according to the present disclosure.
Figure 3:
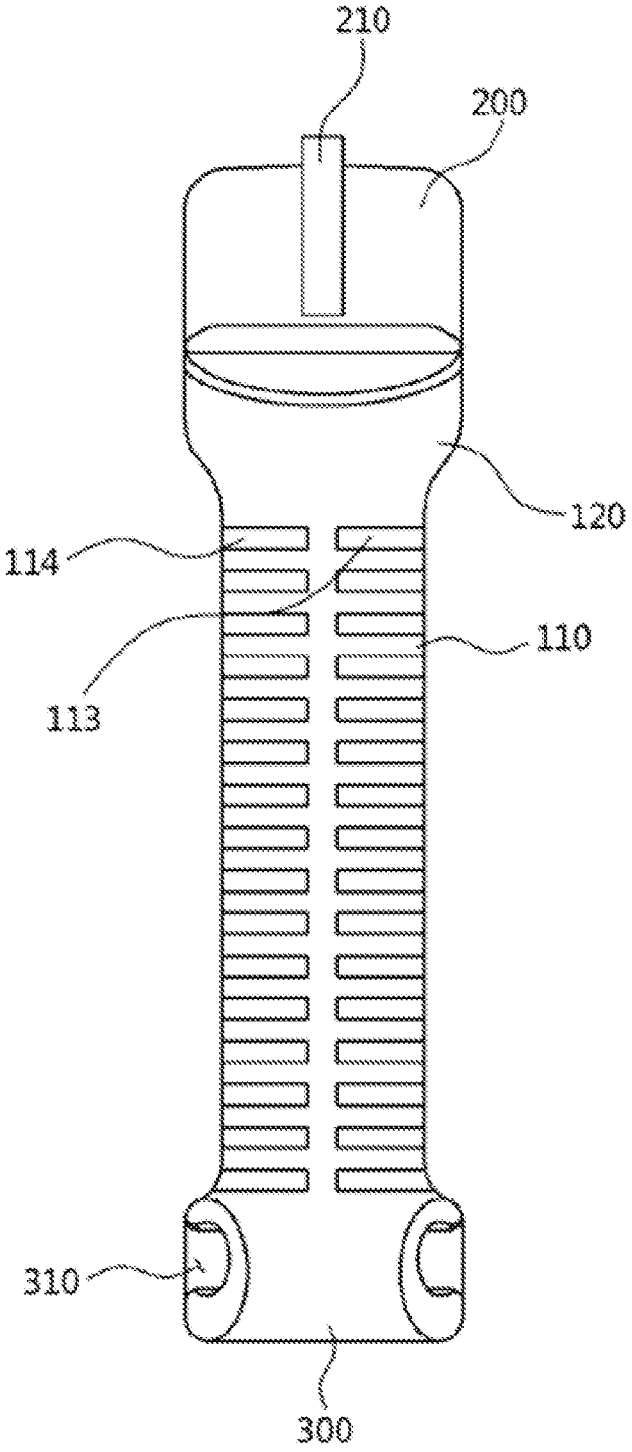
FIG. 3 is a rear view showing the connector for a blast-triggering device according to the present disclosure.
Figure 4:
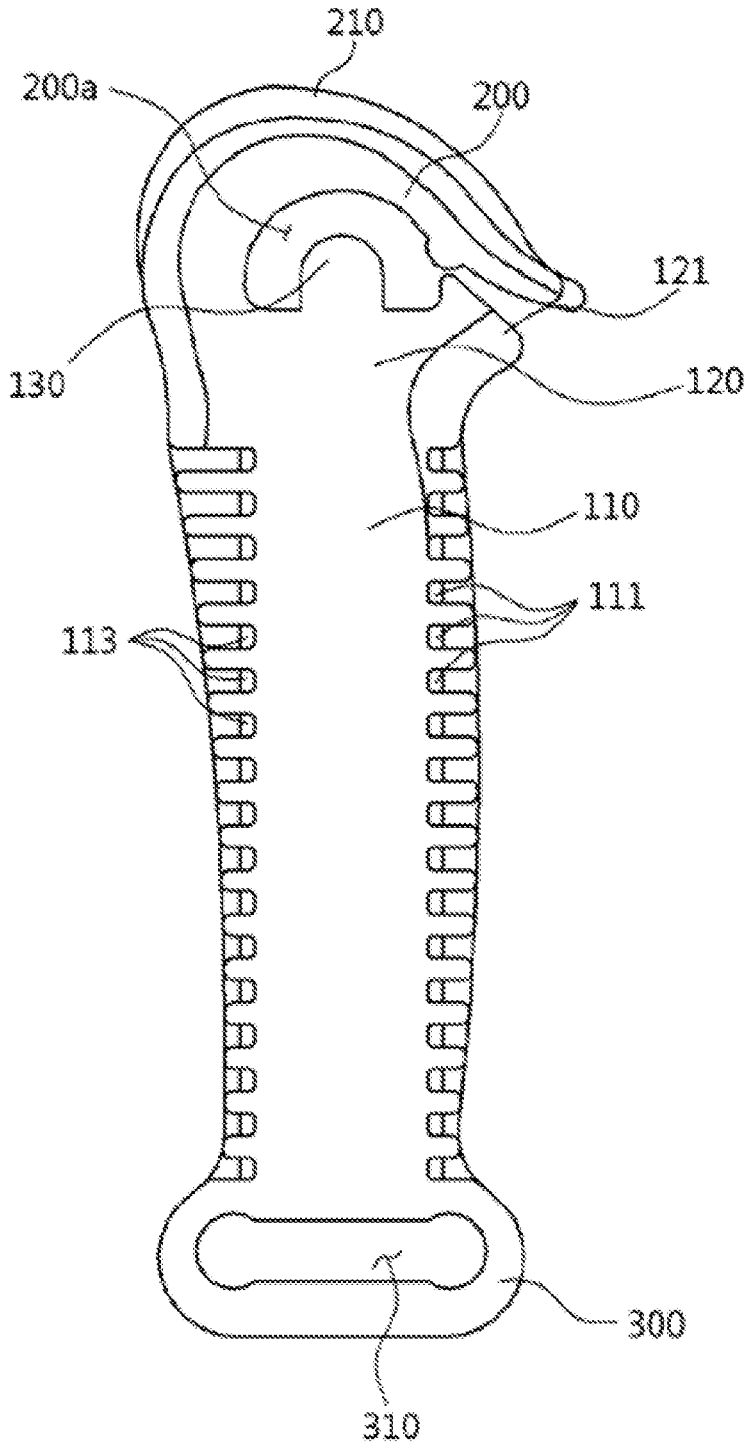
FIG. 4 is a side view showing the connector for a blast-triggering device according to the present disclosure.

FIG. 2 is a perspective view showing a connector for a blast-triggering device according to the present disclosure; FIG. 3 is a rear view showing the connector for a blast-triggering device according to the present disclosure; and FIG. 4 is a side view showing the connector for a blast-triggering device according to the present disclosure.

Figure 5:
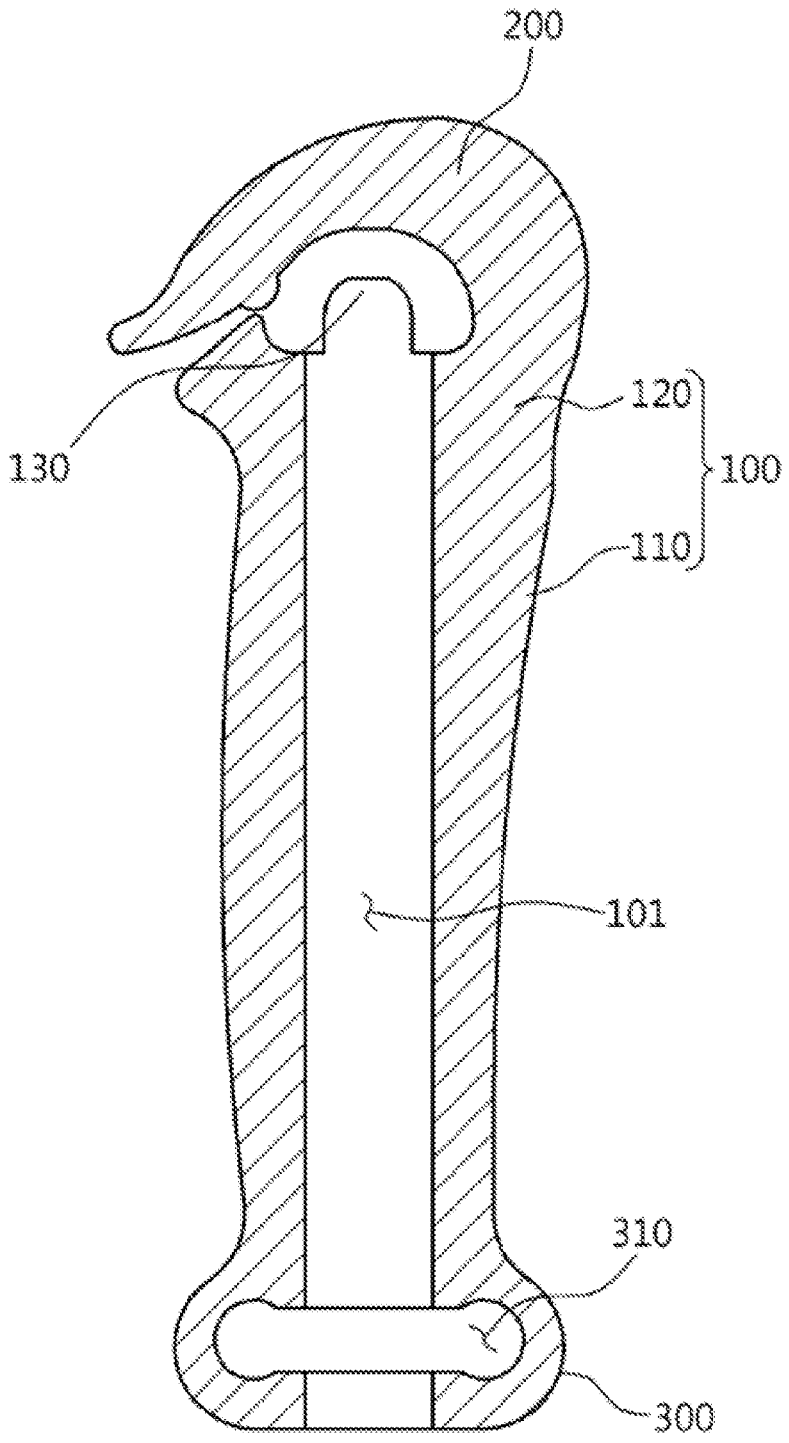
FIG. 5 is a sectional view showing the connector for a blast-triggering device according to the present disclosure.
Figure 6:
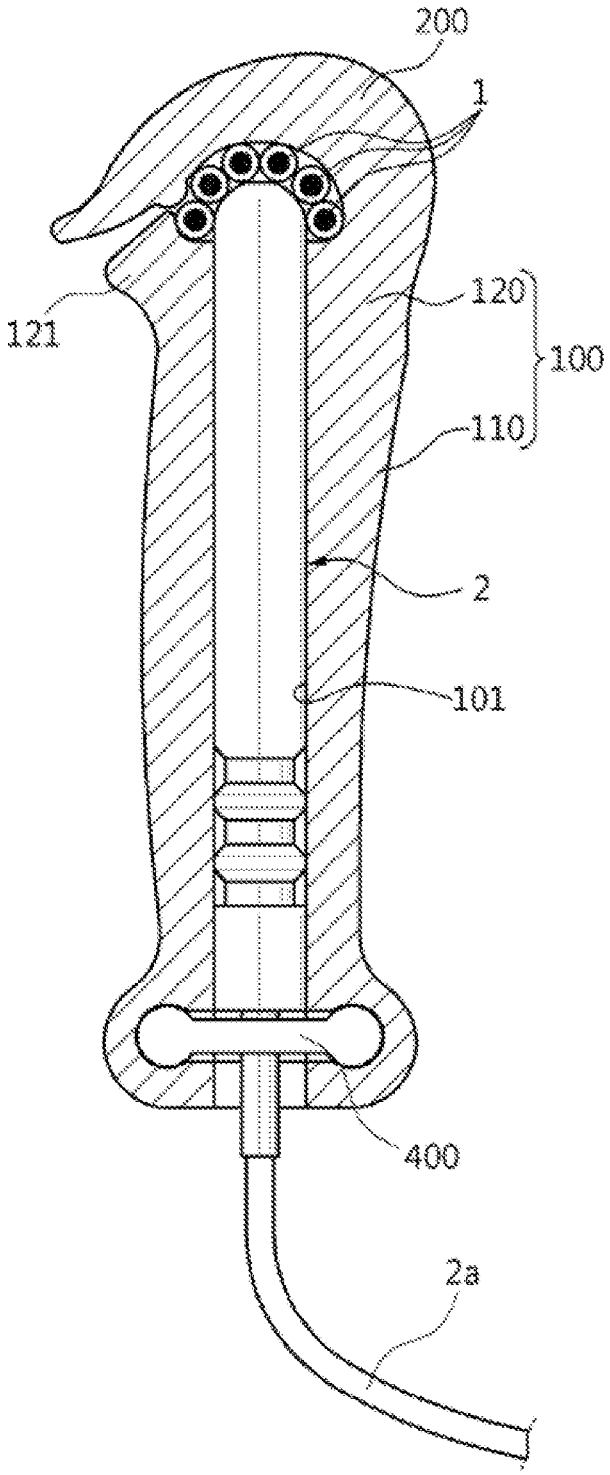
FIG. 6 is a sectional view showing an operation state of the connector for a blast-triggering device according to the present disclosure.

FIG. 5 is a sectional view showing the connector for a blast-triggering device according to the present disclosure; and FIG. 6 is a sectional view showing an operation state of the connector for a blast-triggering device according to the present disclosure.

Referring to FIGS. 2 to 6, the connector for a blast-triggering device includes: a connector body 100; a connector head 200 provided on the connector body 100; and a clip-fixing body 300 provided under the connector body 100.

The connector body 100, the connector head 200, and the clip-fixing body 300 are integrally formed into a single body, and each is made by mixing one material or at least two materials of high-density polyethylene, intermediate-density polyethylene, polypropylene, metallocene linear low-density polyethylene, and polyamide, or may be made of any known synthetic resin material.

The connector body 100 has a rectangular rod shape including front and rear surfaces and opposite side surfaces. A detonator insertion portion 101 is formed so as to pass through the inside of the connector body 100 in a longitudinal direction thereof for insertion of a detonator therein. A trunkline delay detonator 2 is inserted into the detonator insertion portion 101, and detonates to apply an explosion signal to a plurality of shock tubes 1.

The rear end of the connector head 200 is integrally connected to the rear upper surface of the connector body 100. An upper surface of the connector head 200 is has a curved shape by extending from the rear end of the connector head 200 to the front end thereof, and the front end thereof is separated from the connector body 100.

Further, between a lower surface of the connector head 200 and the connector body 100, a tube insertion portion 200*a* is formed by passing through the connector in opposite side directions of the connector body 100, so that the plurality of shock tubes 1 connected to a detonator for initiating an explosive is fitted therein.

The connector body 100 includes: a main body member 110 having a rectangular rod shape; and a head-supporting member 120 provided at an upper end of the main body member 110, formed by extending outwards from a circumference of the main body member 110, and formed such that the rear surface thereof is integrally connected with the connector head 200 and the front surface thereof is separated from the front end of the connector head 200.

The main body member 110 has a first horizontal groove 111 and a second horizontal groove 112 in the front surface thereof. The first horizontal groove 111 and the second horizontal groove 112 are spaced apart from each other on the basis of the center of the front surface thereof, and are open in opposite side directions of the main body member 110. The first horizontal groove 111 and the second horizontal groove 112 are each provided in a plural number, the first horizontal grooves 111 are spaced apart from each other in the longitudinal direction of the main body member 110, and the second horizontal grooves 112 are spaced apart from each other in the longitudinal direction of the main body member 110.

Further, the main body member 110 has a third horizontal groove 113 and a fourth horizontal groove 114 formed in the rear surface thereof. The third and fourth horizontal grooves 113 and 113 are space apart from each other on the basis of the center of the rear surface thereof, and are open in the opposite side directions of the main body member 110. The third and fourth horizontal grooves 113 and 113 are each provided in a plural number, the third horizontal grooves 113 are spaced apart from each other in the longitudinal direction of the main body member 110, and the fourth horizontal grooves 114 are spaced apart from each other in the longitudinal direction of the main body member 110.

The first horizontal grooves 111 and the second horizontal grooves 112, and the third horizontal grooves 113 and the fourth horizontal grooves 114, formed in the front and rear surfaces of the main body member 110, respectively, are provided to increase the rigidity of the main body member 110. Thereby, damage to the main body member 110 is prevented when the trunkline delay detonator 2 detonates in the detonator insertion portion 101, and usability is increased.

The head-supporting member 120 is provided with a guide protrusion 121 on the front surface thereof, the guide protrusion 121 being in contact with the front end of the connector head 200. The guide protrusion 121 is formed such that a gap between the guide protrusion 121 and the connector head 200 gradually widens from the contact portion with the connector head 200 toward the front end of the connector head 200.

The gap between the front end of the connector head 200 and the guide protrusion 121 has a form that gradually narrows from an opening of the gap toward the inside thereof. Accordingly, the plurality of shock tubes 1 may be easily inserted into the tube insertion portion 200*a* by lifting the connector head 200 upwards at the opening and then widening a void space of the tube insertion portion 200*a* formed between the connector head 200 and the connector body 100, that is, the head-supporting member 120.

Opposite side surfaces of the connector head 200 may be formed as flat surfaces.

Further, the connector head 200 may have a spherical shape in which all of upper and opposite side surfaces are curved.

The connector head 200 is preferably provided with a head protrusion 210 on the upper surface thereof. The head protrusion 210 is formed so as to extend from the rear end of the connector head to the front end thereof.

The head protrusion 210 protrudes from the center of the upper surface of the connector head 200, and has a curved upper end corresponding to the curved upper surface of the connector head 200.

The head protrusion 210 increases the rigidity of the connector head 200 in order to prevent the connector head 200 from being damaged when the trunkline delay detonator 2 detonates in the detonator insertion portion 101.

An upper end of the trunkline delay detonator 2 is formed in a hemispherical shape around a central upper flat surface thereof, and the lower surface of the connector head 200 is formed to have a flat surface corresponding to the central upper flat surface of the trunkline delay detonator 2 and a curved surface corresponding to the hemispherical shape thereof. Thus, the plurality of shock tubes 1 is fitted between an outer circumferential surface of the trunkline delay detonator 2 and the lower surface of the connector head 200.

Further, the curved surface of the lower surface of the connector head 200 is preferably formed in a semicircular shape that is the same as the hemispherical shape of the trunkline delay detonator 2 protruding into the tube insertion portion 200*a*.

Thus, between the upper end of the trunkline delay detonator 2 and an upper surface of the tube insertion portion 200*a*, the plurality of shock tubes 1 having the same diameter may be in uniform contact with the outer circumferential surface of the upper end of the trunkline delay detonator 2.

Further, side protrusions 130 for supporting tubes are provided on the upper surface of the connector body 100. The side protrusions 130 for supporting tubes are formed by protruding into the tube insertion portion 200*a* to be spaced apart from each other, and the upper end of the trunkline delay detonator 2 is disposed therebetween.

Each of the side protrusions 130 for supporting tubes is a protrusion having a semicircular shape when viewed from a lateral direction of the connector body 100, and may have the same radius as the hemispherical shape of the upper end of the trunkline delay detonator 2.

The side protrusions 130 for supporting tubes are disposed at opposite sides of the upper end of the trunkline delay detonator 2 protruding into the tube insertion portion 200*a*. The side protrusions 130 for supporting tubes are each formed to surround a portion of the outer circumferential surface of the upper end of the trunkline delay detonator 2.

The side protrusions 130 for supporting tubes serve to make the connector head 200 more resistant to shocks when the trunkline delay detonator 2 detonates in the detonator insertion portion 101. Thus, the connector head 200 can maintain the shape thereof, and scattering of debris in the detonator insertion portion 101 during detonation can be prevented.

The side protrusions 130 for supporting tubes support the shock tubes 1 fitted into the tube insertion portion 200*a* to prevent the upper end of the trunkline delay detonator 2 from being displaced in position while being depressed downward from the side protrusion 130 for supporting tubes. Further, the side protrusions 130 for supporting tubes allow the upper end of the trunkline delay detonator 2 to be positioned at the same level as upper ends of the side protrusions 130 for supporting tubes, so that the plurality of shock tubes 1 fitted in the tube insertion portion 200*a* can be fixed while being in uniform contact with the outer circumferential surface of the trunkline delay detonator 2.

The clip-fixing body 300 is integrally provided with a lower end of the connector body 100, and is formed by protruding from a circumference of the lower end of the connector body 100.

The clip-fixing body 300 has an opening of the detonator insertion portion 101 in a lower surface thereof, and the clip-fitting portion 310 is formed by passing through opposite side surfaces of the clip-fixing body 300.

The fixing clip 400 is fitted in the clip-fitting portion 310. The fixing clip 400 supports a lower end of the trunkline delay detonator 2 inserted into the detonator insertion portion 101 to fix the position of the trunkline delay detonator 2.

The fixing clip 400 is provided with a tube-fitting groove 410 into which the detonation tube 2*a* connected to the trunkline delay detonator 2 is fitted. As the detonation tube 2*a* is inserted into the tube-fitting groove 410, the fixing clip 400 supports the lower end of the trunkline delay detonator 2 to prevent the trunkline delay detonator 2 from being moved downwards in the longitudinal direction of the connector body 100.

Thus, when the detonation tube 2*a* is pulled at a blasting field, the upper end of the trunkline delay detonator 2 moves no further downwards from a contact position with the shock tubes 1 in the tube insertion portion 200*a*. Accordingly, the close contact state between the shock tubes 1 and the trunkline delay detonator 2 can be maintained.

It is preferable that a total length including the connector body 100, the connector head 200, and the clip-fixing body 300 be 65~110 mm.

The above length range serves to allow the connector body 100, the connector head 200, and the clip-fixing body 300 to maintain the shapes thereof during detonation of the trunkline delay detonator 2.

It is preferable that the thickness between the opposite side surfaces of the connector body 100 is 15~50 mm. The above thickness range serves to allow the connector body 100 to maintain the shape thereof during detonation of the trunkline delay detonator 2.

It is preferable that the diameter of the detonator insertion portion 101 be 7.1~9.5 mm. The above diameter range serves to allow the trunkline delay detonator 2 to be fixed in a fitted state in the detonator insertion portion 101, and to allow the connector body 100 to maintain the shape thereof during detonation of the trunkline delay detonator 2.

It is preferable that the thickness between the upper surface and the lower surface of the connector head 200 be 3~15 mm. The above thickness range serves to allow the connector head 200 to maintain the shape thereof during detonation of the trunkline delay detonator 2.

It is preferable that the gap between the lower surface of the connector head 200 and the outer upper circumferential surface of the side protrusion 130 for supporting tubes be 2.5~4.5 mm. The above gap range serves to allow the shock tubes 1 to be fixed in the uniform contact state with the outer circumferential surface of the trunkline delay detonator 2 and to allow the connector head 200 to maintain the shape thereof.

According to the present disclosure, the blast-triggering device is configured as follows. The trunkline delay detonator 2 is inserted into the detonator insertion portion 101 and protrudes into the tube insertion portion 200*a*, so that the upper end of the trunkline delay detonator 2 is positioned up to the same level as the upper end of the side protrusion 130 for supporting the tubes. Then, the plurality of shock tubes 1 is fitted into the tube insertion portion 200*a* and is brought into close contact with the outer circumferential surface of the trunkline delay detonator 2.

The present disclosure is configured to maintain the shape of the connector during detonation to minimize debris. Accordingly, safety during detonation is improved.

The present disclosure is configured to maintain the shape of the connector during detonation to prevent damage to the shock tubes 1 due to the debris, the shock tubes 1 being connected to the detonator for initiating an explosive. Accordingly, a cut-off phenomenon attributable to damage to the shock tubes 1 is prevented, and detonation reliability is improved.

The connector of the present disclosure is configured to improve closeness of contact with the plurality of shock tubes 1 connected to the trunkline delay detonator 2 and the detonator for initiating an explosive that are inserted in the connector so as to uniformly apply shock waves to each of the shock tubes during detonation. Accordingly, uniformity of an input signal applied to the shock tubes can be secured, an explosion signal can be uniformly applied to a plurality of detonators for initiating an explosion, and malfunction of a detonator for initiating an explosion can be prevented.

Although a preferred embodiment of the present disclosure has been described for illustrative purposes, those skilled in the art will appreciate that various modifications, additions and substitutions are possible without departing from the scope and spirit of the invention as disclosed in the accompanying claims, and the scope of the present disclosure should be interpreted on the basis of the claims.

The invention claimed is:

1. A connector for a blast-triggering device, the connector comprising:

a connector body having a rectangular rod shape including front and rear surfaces and opposite side surfaces, and having therein a detonator insertion portion, which passes through the connector body in a longitudinal direction of the connector body, so that a trunkline delay detonator is inserted into the detonator insertion portion;

a connector head configured such that a rear end thereof is integrally connected with a rear surface of the connector body, an upper surface thereof is formed in a curved surface extending from the rear end thereof to a front end thereof, a tube insertion portion of a void is provided between a lower surface thereof and the connector body so that a plurality of shock tubes connected to a detonator for initiating an explosive is fitted therein, and the front end thereof is separated from the connector body;

a clip-fixing body, which is integrally provided with a lower end of the connector body, is formed by protruding from a circumference of the lower end of the connector body, has an opening of the detonator insertion portion in a lower surface thereof, and has a clip-fitting portion formed by passing through opposite side surfaces of the clip-fixing body; and a fixing clip fitted in the clip-fitting portion to fix the trunkline delay detonator that is inserted into the detonator insertion portion, wherein a head protrusion is on the upper surface of the connector head and protrudes from the rear end of the connector head to the front end of the connector head, an upper end of the trunkline delay detonator is formed in a hemispherical shape around a central upper flat surface thereof and protrudes into the tube insertion portion, and a lower surface of the connector head has a flat surface corresponding to the central upper flat surface of the trunkline delay detonator and a curved surface corresponding to the hemispherical shape thereof, and the curved surface among the lower surface of the connector head has the same center as the hemispherical shape of the trunkline delay detonator.

2. The connector for a blast-triggering device of claim 1, wherein the connector body, the connector head, and the clip-fixing body are integrally formed in a single body, and are each made by using one material or mixing at least two materials selected from among high-density polyethylene, intermediate-density polyethylene, polypropylene, metallocene linear low-density polyethylene, and polyamide.

3. The connector for a blast-triggering device of claim 1, wherein, the connector body comprises:

a main body member having a rectangular rod shape; and a head-supporting member provided at an upper end of the main body member, formed by extending outwards from a circumference of the main body member, and formed such that a rear surface thereof is integrally connected with the connector head and a front surface thereof is separated from a front end of the connector head.

4. The connector for a blast-triggering device of claim 3, wherein the head-supporting member has a guide protrusion at the front surface thereof, and the guide protrusion is configured to be in contact with the front end of the connector head and is formed such that a gap between the guide protrusion and the connector head gradually widens from a contact portion with the connector head toward the front end of the connector head.

5. The connector for a blast-triggering device of claim 3, wherein the main body member is provided with a first horizontal groove and a second horizontal groove spaced apart from each other in a front surface thereof, the first horizontal groove and the second horizontal groove being open toward opposite sides of the main body member, respectively, a plurality of first horizontal grooves being spaced apart from each other in a longitudinal direction of the main body member, and a plurality of second horizontal grooves being spaced apart from each other in the longitudinal direction of the main body member, and the main body member is provided with a third horizontal groove and a fourth horizontal groove spaced apart from each other in a rear surface thereof, the third horizontal groove and the fourth horizontal groove being open toward the opposite sides of the main body member, respectively, a plurality of third horizontal grooves being spaced apart from each other in the longitudinal direction of the main body member, and a plurality of fourth horizontal grooves being spaced apart from each other in the longitudinal direction of the main body member.

6. The connector for a blast-triggering device of claim 1, wherein an upper surface of the connector body is provided with side protrusions for supporting tubes, the side protrusions for supporting tubes protruding into the tube insertion portion to be spaced apart from each other, and receiving an upper end of the trunkline delay detonator therebetween.

7. The connector for a blast-triggering device of claim 6, wherein the side protrusions for supporting tubes each has a semicircular shape when viewed from a lateral direction of the connector body.

8. The connector for a blast-triggering device of claim 7, wherein the side protrusions for supporting tubes each has a same radius as the hemispherical shape in the upper end of the trunkline delay detonator.

9. The connector for a blast-triggering device of claim 1, wherein the fixing clip is provided with a tube-fitting groove in which a detonation tube connected to the trunkline delay detonator is fitted, so that a lower end of the trunkline delay detonator is supported when the detonation tube is inserted into and fitted in the tube-fitting groove.

10. The connector for a blast-triggering device of claim 1, wherein a total length including the connector body, the connector head, and the clip-fixing body is 65~110 mm.

11. The connector for a blast-triggering device of claim 1, wherein a thickness between opposite side surfaces of the connector body is 15~50 mm.

12. The connector for a blast-triggering device of claim 1, wherein a diameter of the detonator insertion portion is 7.1~9.5 mm.

13. The connector for a blast-triggering device of claim 1, wherein a thickness between the upper surface and the lower surface of the connector head is 3~15 mm.

14. The connector for a blast-triggering device of claim 7, wherein a gap between the lower surface of the connector head and an outer upper circumferential surface of the side protrusion for supporting tubes is 2.5~4.5 mm.

* * * * *